United States Patent [19]

Smirlock et al.

[11] Patent Number: 4,776,068

[45] Date of Patent: Oct. 11, 1988

[54] QUIET TOUCH FASTENER MATERIAL

[75] Inventors: Martin E. Smirlock, Concord; Richard Madden, Groton; Jonathan Ludlow, Lexington, all of Mass.

[73] Assignee: Velcro Industries B. V., Amsterdam, Netherlands

[21] Appl. No.: 921,731

[22] Filed: Oct. 20, 1986

[51] Int. Cl.[4] ..... A44B 18/00

[52] U.S. Cl. ..... 24/442; 24/306; 24/444; 2/DIG. 6

[58] Field of Search ..... 24/442, 443, 444, 445, 24/447, 448, 451, 306; 2/DIG. 6, 167; 156/280; 428/138

[56] References Cited

U.S. PATENT DOCUMENTS

| | | | |
|---|---|---|---|
| 1,301,955 | 4/1919 | McKechnie | 156/280 |
| 2,952,925 | 9/1960 | Held | 2/DIG. 6 |
| 3,256,882 | 6/1966 | Huber | 2/DIG. 6 |
| 3,370,818 | 2/1968 | Perr | 24/442 |
| 3,455,589 | 7/1969 | Valiulis | 24/442 |
| 3,469,289 | 9/1969 | Whitacre . | |
| 3,497,925 | 3/1970 | Brumlik . | |
| 3,534,780 | 10/1970 | Hockmeyer | 24/445 |
| 3,726,752 | 4/1973 | Provost | 24/444 |
| 3,731,348 | 5/1973 | Luehne | 24/442 |
| 3,808,648 | 5/1974 | Billarant et al. . | |
| 4,247,586 | 1/1981 | Rochlin | 428/138 |
| 4,355,424 | 10/1982 | McCoy, Jr. | 2/167 |
| 4,470,857 | 9/1984 | Casalou | 24/306 |

FOREIGN PATENT DOCUMENTS

| | | | |
|---|---|---|---|
| 0145603 | 12/1984 | European Pat. Off. . | |
| 1960724 | 6/1970 | Fed. Rep. of Germany . | |
| 1080653 | 8/1967 | United Kingdom | 24/442 |
| 1441328 | 6/1976 | United Kingdom | 24/444 |
| 2160586 | 12/1985 | United Kingdom | 24/442 |

*Primary Examiner*—Victor N. Sakran

*Attorney, Agent, or Firm*—Hayes, Davis & Soloway

[57] ABSTRACT

Silent touch fastener material adapted to releasably engage a mating surface and adapted to produce reduced sound during rapid separation of the touch fastener material from the mating surface. The material comprises a planar backing material having an engaging surface thereon contacting the backing material at discrete points and adapted to releasably engage the mating surface and means for reducing the coupling of noise-producing vibration from the backing material into the surrounding air. Various embodiments disclose the backing material as having a high mass relative to the mass of the engaging surface; a planar high mass supplemental backing material bonded to the backing material; a flexible, high mass material incorporated into the backing material; means disposed at the discrete points of attachment of the engaging surface to the backing material for suppressing the coupling of vibrations produced in the engaging surface into the backing material; and, the backing material comprising a lattice structure having low ability for transferring vibrations induced therein into the air surrounding it.

14 Claims, 5 Drawing Sheets

QUIET TOUCH FASTENER MATERIAL

BACKGROUND OF THE INVENTION

The present invention relates to touch fastener material and, more particularly though not exclusively, to quiet hook and loop touch fastener material adapted to releasably engage a mating surface and adapted to produce reduced sound during rapid separation of the touch fastener material from the mating surface and comprising: a planar backing material having an engaging surface thereon contacting the backing material at discrete points and adapted to releasably engage the mating surface; and, means for reducing the coupling of noise-producing vibration from the backing material into the surrounding air.

The term "touch fastener material", as employed in this application, comprises two components, namely, a first planar backing material having a surface carrying hooks, mushrooms, balls on stems, pigtails, or the like, capable of engaging loops, hooks, mushrooms, balls on stems, pigtails, or the like, carried by a second planar backing material to releasably fasten items together, such as those products sold by the assignee of the present invention under the trademark VELCRO.

Touch fastener materials have grown rapidly in public acceptance and their uses appear unlimited. Unlike other devices such as zippers, and the like which require proper alignment and component tolerances to operate and not jam, touch fasteners are virtually indestructible and need only be pressed together with mating surfaces in contact with one another to effect attachment. For belts, and the like, they provide infinite adjustment capabilities. All this is to say that they are very well suited for military applications where such qualities are important and appreciated.

Unfortunately, touch fastener materials according to the prior art have suffered from a single drawback which has caused concern in some military applications as well as annoyance to certain other users—noise upon separation. Typical VELCRO brand hook and loop type touch fastener material and the noise associated therewith is shown in simplified form in FIGS. 1–3. As depicted in FIG. 1, the touch fastener material 10 comprises a first planar backing material 12 having an engaging surface thereon comprising, for example, resiliently flexible J-shaped hooks 14 attached to the backing material 12 at discrete points. Touch fastener material 10 also includes a second planar backing material 16 having a mating surface thereon such as, for example, loops 18. The touch fastener material 10 is releasably engaged by pressing the hooks 14 into engagement with the loops 18 where they are ensnared to hold the two portions together as shown in FIG. 2. Like zippers and their characteristic "zipping" noise, conventional touch fastener materials are easily identified by their characteristic "ripping" noise 20 when the two portions are peeled apart as depicted in FIG. 3.

Wherefore, it is the object of the present invention to provide touch fastener material characterized by a greatly reduced sound level when the two portions are peeled apart during separation.

SUMMARY

The foregoing object has been realized by the silent touch fastener material of the present invention which is adapted to releasably engage a mating surface and adapted to produce reduced sound during rapid separation of the touch fastener material from the mating surface comprising: a planar backing material having an engaging surface thereon contacting the backing material at discrete points and adapted to releasably engage the mating surface; and, means for reducing the coupling of noise-producing vibration from the backing material into the surrounding air.

In one approach to the present invention, the noise coupling reduction means comprises the backing material having a high mass relative to the mass of the engaging surface. In one embodiment, the high mass of the backing material is produced by bonding a planar high mass supplmental backing material to the backing material. In a second embodiment, the high mass of the backing material is produced by incorporating a flexible, high mass material into the backing material. The preferred high mass material comprises a material having the qualities and characteristics of leaded vinyl.

In a second approach, the noise coupling reduction means comprises means disposed at the discrete points of attachment of the engaging surface to the backing material or suppressing the coupling of vibrations produced in the engaging surface into the backing material.

In a third approach, the noise coupling reduction means comprises the backing material being an open lattice structure having low ability for transferring vibrations induced therein into the air surrounding it.

DESCRIPTION OF THE PREFERRED EMBODIMENTS

The solution to the noise problem of touch fastener material which led to the development of the product line to be marketed by the assignee of this application under the trademark STEALTH VELCRO was not an easy or readily apparent one. The research described hereinafter was done on hook and loop fastener materials; however, the finding would be relevant to all touch fastener materials.

The applicants herein initially assumed (inaccurately, as we were to find out later) that the bulk noise came from vibration of the hooks 14. We tried to characterize that noise with measurements of individual hook and loop radiation. We ultimately discovered that our original assumption was not correct because the sound pressure level from an individual hook was quite low, and the oscillation, when it could be measured, was well up into the high frequency range greater than 10 kHz.

Figure 1:
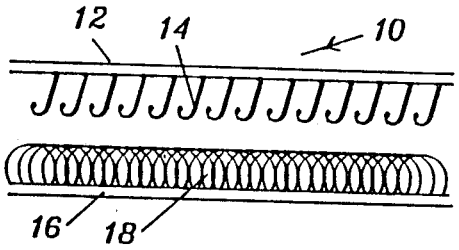
Fig. 1 PRIOR ART
FIG. 1 is a simplified drawing of touch fastener material of the hook and loop type showing the components thereof in their separated state.
Figure 2:
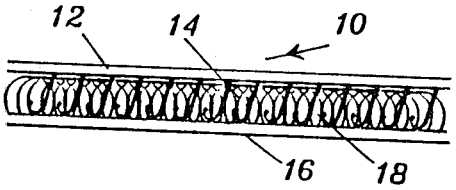
Fig. 2 PRIOR ART
FIG. 2 is a simplified drawing of touch fastener material of the hook and loop type as in FIG. 1 showing the components thereof in their joined state.
Figure 3:
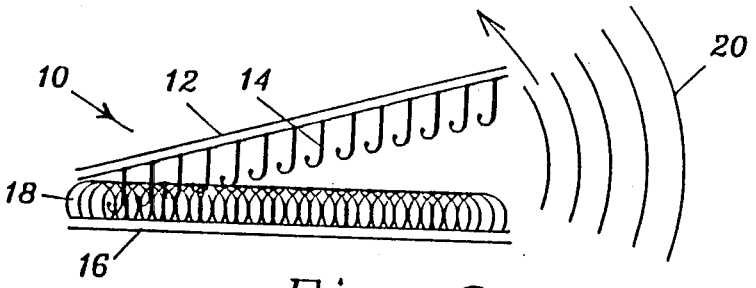
Fig. 3 PRIOR ART
FIG. 3 is a simplified drawing of touch fastener material of the hook and loop type as in FIGS. 1 and 2 showing the noise production problem addressed by the present invention.
Figure 4:
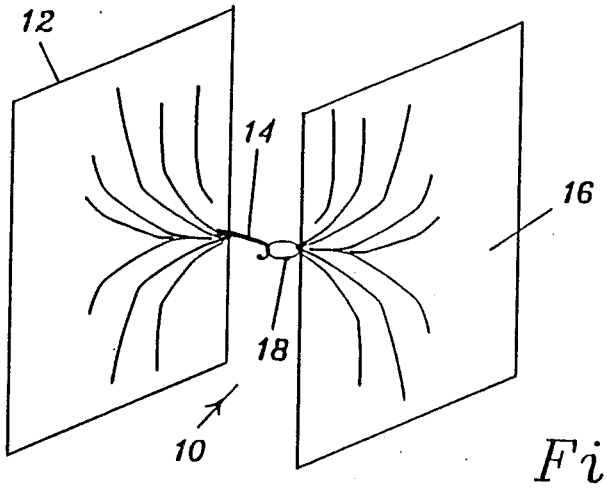
Fig. 4 PRIOR ART
FIG. 4 is a simplified drawing illustrating the cause of the problem addressed by the present invention.

This led to the creation (i.e. development) of a different theoretical model as shown in simplified form in FIG. 4. This was one of a membrane or plate, given an initial deflection as a result of the tension created in a hook/loop pair, just prior to the moment of disengagement. Thus, it was now (accurately, this time) assured that the backing materials 12, 16 act much like a speaker cone or sounding board; that is, once the hook and loop are released, the deflected portions of the backing strips surrounding discrete points of attachment to the engaging surface materials tend to restore themselves to their original flat shape and, in doing so, produce the noise that is heard. Once this had been established, the search for a solution focused on mechanisms to defeat the conversion of this "diaphragm" or deflected plate motion into air-borne noise.

The sound power generated in the near field of this action in a flat plate is determined by the relationship:

$$W_p \sim \frac{F^2 \rho_{air}}{2\pi(\rho_{plate})^2 C}$$

where

F=the force input (in our case tension)

$\rho_{air}$=the density of the air

C=the velocity of sound in air $\rho_{plate}$=the aerial density of the plate.

Based upon the above-described relationship, it became clear that one could hope to achieve the desired sound reduction by (1) reducing the force (i.e. the tension) of the hooks 14, (2) increasing the density of the plate, (3) decreasing the ability of the plate to couple the sound into the air, or (4) decreasing the effect of the force in deflecting the plate. Connection (or tear) strength is the most desirable quality of the product and, therefore, must be maintained—thus eliminating option (1) above and leaving those options effecting the aerial density of the plate as the parameters of possible control and/or alteration to obtain the desired results in noise reduction.

Figure 5:
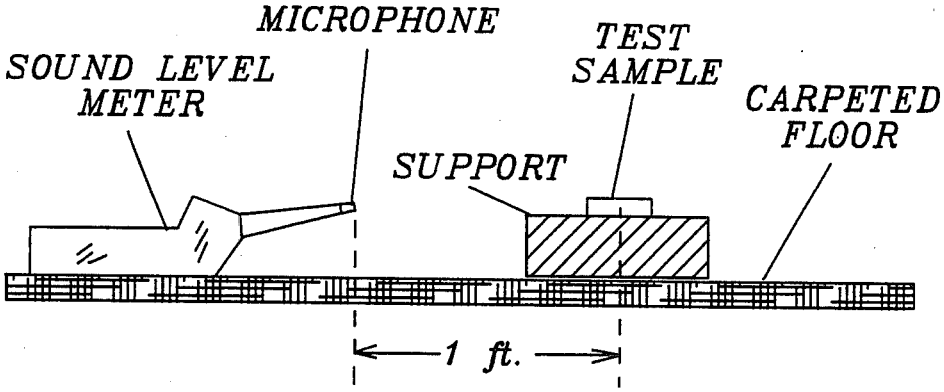
FIG. 5 is a drawing showing the testing apparatus employed in developing and testing the present invention.
Figure 6:
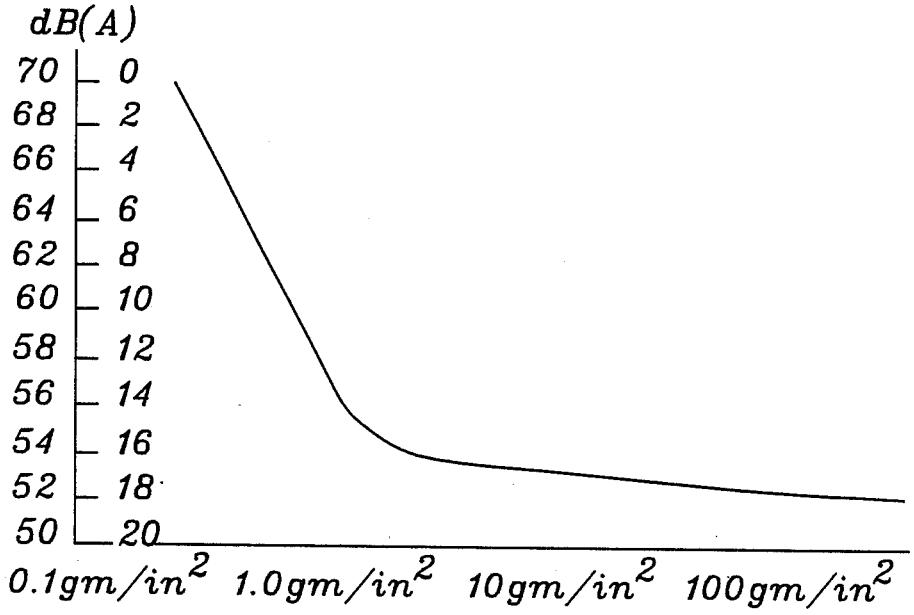
FIG. 6 is a graph showing test findings relative to noise as a function of the mass of the backing material of the touch fastener material.

To investigate cause and effect in the pursuit of a silent touch fastener material, the test setup of FIG. 5 was employed. By varying the mass of the support to which the fastener materials 10' were attached the mass of the backing material could be varied up to a virtual infinity level. Primary emphasis was initially made on the hypothesis that as mass was added to the hook and loop tape, the noise produced upon separation should decrease, and furthermore, the relationship should be logarithmic in nature. To investigate the correctness of the hypothesis, a series of samples was prepared, as was a reference standard. The reference standard consisted of a massive structural member chosen to contribute a minimum of acoustical input, namely a steel bar ¾ in.×2 in.×6 in. to which was rigidly bonded both hook and loop tape, each on either side, and was used as the mating half for various embodiments under investigation. A 1-slug (32 lb.) lead brick was later used as contributing even less noise to the noise of separation. Using the test setup of FIG. 5, data was collected on a variety of samples each having been bonded to a backing material of different aerial density ranging from paper through lead doped vinyl to lead sheet (1/16 in.) and finally on to a 1-slug (32 lb.) lead brick. The measurements involved the measurement of dB(A) on a IEC651 type 1L meter (according to ANSI 51.4-1983 type 1) set to measure RMS, fast response, random incidence at 1 foot from the fastener noise produced at a separation rate of about 6 inches/second (which is believed representative of a normal separation rate of between about 3 and about 12 inches/second for touch fasteners, particularly hook and loop fasteners). FIG. 6 illustrates the data and the relationship between aerial density (mass) and noise. A relationship is evident throughout the first order of magnitude of mass. The plot indicates that sound pressure level in dB(A) reduces by approximately 4.2 dB for each doubling in aerial density. This relationship appears to diminish greatly after aerial density is increased approximately 40 fold. This is not of great concern, however, since the test data indicates that only a moderate increase in mass would be necessary in order to diminish the noise to a commercially acceptable level.

A second thrust was then taken and investigated relative to the diminishing of the noise level. This is shown in simplified form in FIGS. 8 and 9. While the mass addition method described above was directed to limiting the velocity and displacement of the oscillating diaphragm created by the backing upon hook release, the alternate method was directed to reducing both the area and coupling efficiency between the diaphragm (backing) and the atmosphere. This was based on the alternate hypothesis that noise could be reduced by opening the structure to the passage of air so that, as it vibrates, the air simply flows from one side to the other; that is, if the backing were in the form of a lattice structure like that of a tennis racquet, radiation would take place from strings or linear members rather than from a plate or membrane and, therefore, the efficiency of coupling into the surrounding air would be greatly reduced.

Figure 7:
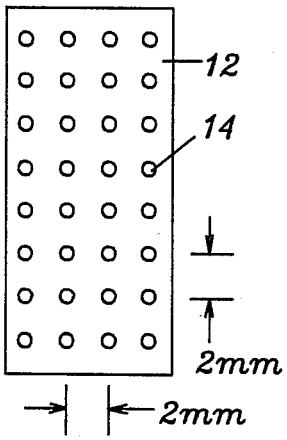
FIG. 7 is a simplified drawing showing the construction dimensions of prior art touch fastener material as tested and compared for noise producing qualities.
Figure 9:
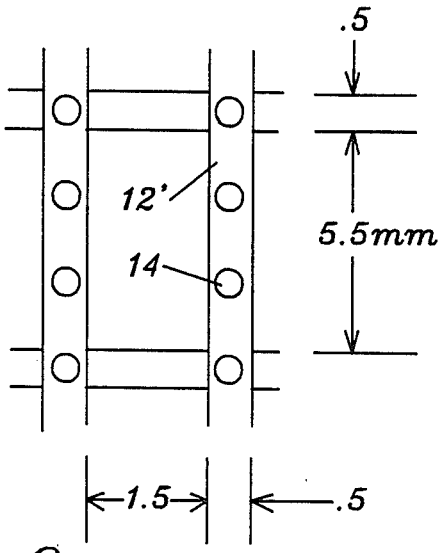
FIG. 9 is an enlarged drawing of a portion of the material of FIG. 8.
Figure 8:
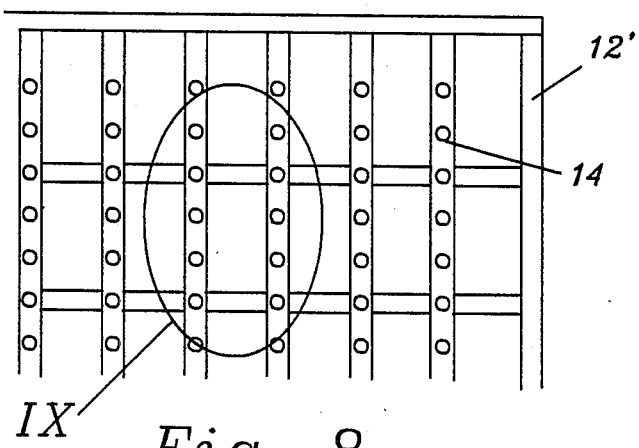
FIG. 8 is a simplified drawing showing the construction dimensions of touch fastener material according to the present invention in a first embodiment as tested for noise producing qualities.

To investigate this approach, samples were specially prepared by injection molding in both continuous membrane and open "net" type construction as illustrated in FIG. 7 and FIGS. 8 and 9, respectively. It was anticiptated, that, for significant results, the open area of the net should be greater than 50 percent; and, in the tested embodiment, actually represented approximately 70 percent of the total area. Aside from this difference, all aspects of the samples (e.g. hook shape, hook spacing, material, etc.) were the same as in the samples used in the increased mass testing described above. Acoustic comparisons of the two samples revealed that the net construction of FIGS. 8 and 9 was responsible for a 10 to 12 db(A) decrease in sound power or noise level. It is believed that part of the noise reduction realized was due to a reduction in the area available for radiation. Thus, in reducing the area by 70 percent, we expected a reduction in sound power of approximately 5 dB (i.e. 10 $\log \times 1/(1-0.7)=5.23$). This, however explains only about one-half the actual observed reduction. The remainder is thought to be due to the reduced efficiency of coupling a moving string or net to the air; i.e., the air is free to flow around the string as it moves and coupling is simply not accomplished effectively. Since it was decided to develop the commercial embodiment in the manner of the first approach described above through increased mass of the backing material, further in depth research on the "net" backing was not pursued.

Figure 10:
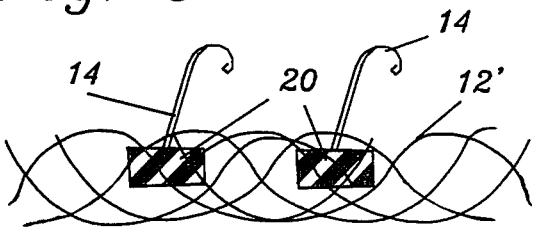
FIG. 10 is a simplified drawing showing the construction of touch fastener material according to the present invention in a possible second embodiment.

The test results did indicate, however, that a third viable approach could be employed which, because of its complexity on a commercial basis, was bypassed by the applicants herein with respect to actual testing. That approach is the mounting of the hooks to the backing material at their discrete points of attachment with a decoupling material whereby the tension on the hooks is not reduced for purposes of grip strength of the touch fastening material; but, has reduced transmission or coupling into the backing material. It is contemplated, that, for example as shown in simplified form in FIG. 10, the hooks 14 could be attached to the backing material 12 by means of an elastomeric material 22 which would stretch during separation and thereby eliminate or absorb part of the deflection of the backing material 12. Again, although considered as part of the present invention, this approach is mentioned in passing only and not considered as a preferred embodiment.

Figure 11:
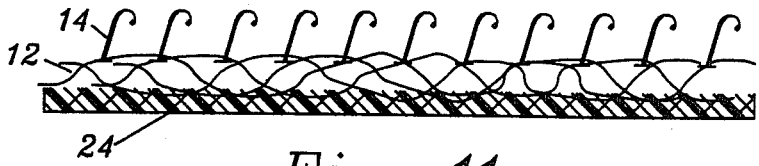
FIG. 11 is a simplified drawing showing the construction of touch fastener material according to the present invention in a third embodiment as tested for noise producing qualities.
Figure 12:
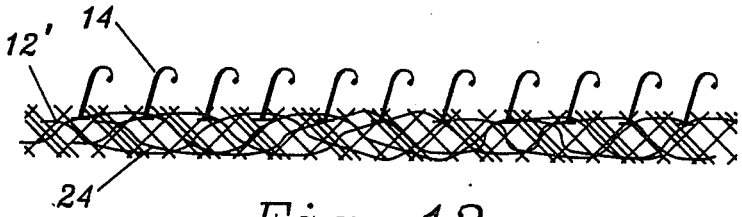
FIG. 12 is a simplified drawing showing the construction of touch fastener material according to the present invention in a fourth embodiment as anticipated to be the commercial embodiment thereof.

Turning now to FIGS. 11 and 12, two approaches to the preferred embodiment as are now being investigated and developed for incorporation in the assignee's STEALTH VELCRO product are shown in simplified form. In FIG. 11, standard backing material 12 with standard hooks 14 thereon has a mass-increasing material 24 bonded to the back surface thereof. In tested embodiments to date, the material 24 has comprised leaded vinyl. It is assumed, however, that other materials exhibiting the same qualities and characteristics could be employed with equally beneficial results. The presently anticipated commercial embodiment is shown in FIG. 12 and comprises a backing material 12' with standard hooks 14 into which backing material a mass-increasing material such as leaded vinyl has been incorporated.

Figure 13:
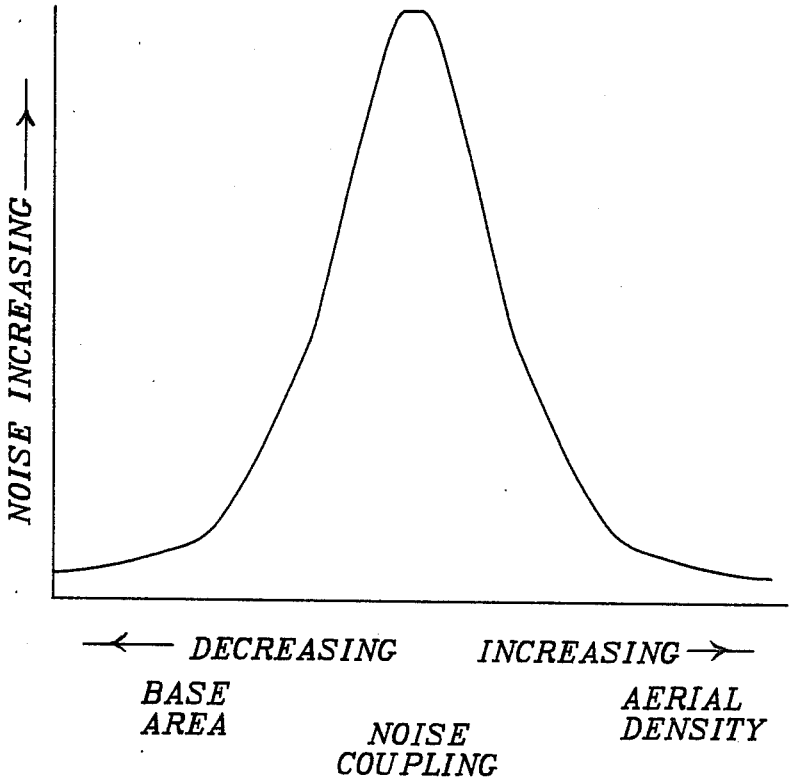
FIG. 13 is a graph showing the effect of general approaches to the present invention in reducing noise in touch fastener material.

The findings of the testing relative to the present invention are summarized in the graph of FIG. 13. As shown therein the prior art construction for touch fastening materials happen to fall on a maximum noise producing point. By increasing the aerial density of the backing material, the noise can be significantly reduced. Similarly, by decreasing the base area of the backing material, a significant noise reduction can be realized.

The following data was generated during the testing of Velcro's existing H-80 (hook material) and L-1000 (loop material) product lines, all of which were modified by increasing the density of the backing material except for the first line in each table which is the unmodified original density material. These test results are only a sample of the generated data:

| % Weight of the Sample | | Aerial Density (hook plus backing in gm/in$^2$) | Sound Pressure Level (SPL) in dB(A) |
|---|---|---|---|
| Backing | Hook | | |
| 75 | 25 | 0.1919 | 68.7 |
| 86 | 14 | 0.3409 | 66.5 |
| 94 | 6 | 0.8642 | 60.2 |
| 97 | 3 | 1.5825 | 57.2 |
| 98.4 | 1.6 | 3.0245 | 54.1 |
| 98.9 | 1.1 | 9.0 | 52.0 |
| c.100 | c.0 | 2,235 | 51.1 |

-continued

| % Weight of the Sample | | Aerial Density (loop plus backing in gm/in) | Sound Pressure Level (SPL) in dB(A) |
|---|---|---|---|
| Backing | Loop | | |
| 55 | 45 | 0.2330 | 67.4 |
| 72 | 28 | 0.3791 | 65.7 |
| 88 | 12 | 0.8951 | 59.4 |
| 94 | 6 | 1.7518 | 55.2 |
| 97 | 3 | 3.3452 | 53.9 |
| 98.8 | 1.2 | 9.0 | 52 |
| c.100 | c.0 | 2,235 | 50.9 |

Hence it appears that separation noise levels of less than 66 dB(A) and even less than 60 or 54 dB(A) can be satisfactory and practically achieved.

From the above data, it is readily apparent that Velcro's existing product lines can be modified so as to reduce the noise level by increasing the aerial density.

Wherefore, having thus described our invention, we claim:

1. Silent touch fastener material, to releasably engage a mating surface and adapted to produce less sound than prior art touch fasteners during rapid separation of the touch fastener material from the mating surface, said touch fastener material comprising:

(a) a planar backing material having an engaging surface thereon, extending therefrom at discrete points and adapted to releasably engage the mating surface; and, (b) the backing material comprising a lattice structure having low ability for transferring vibrations induced therein into the air surrounding it thereby providing means for reducing the coupling of noise-producing vibration from said backing material into the surrounding air upon separation of said touch fastener material.

2. The silent touch fastener material of claim 1 said lattice structure comprising at least 50% air space.

3. The silent touch fastener material of claim 2 said lattice structure comprising at least 70-% air space.

4. A touch fastener material according to claim 1 having a noise of separation of less than about 66 dB(A), at a normal rate of separation, when measured at 1 foot from the area of separation of the fastener with one component of the fastener being rigidly attached to a massive structural member chosen to contribute minimum noise to the noise of separation, measurement being made by a sound meter meeting ANSI 51.4-1983 type 1 and set to RMS, fast response and random incidence, the fastener being a hook and loop fastener.

5. A touch fastener according to claim 4 wherein the noise of separation is less than about 60 dB(A).

6. A touch fastener according to claim 4 wherein the noise of separation is less than about 54 dB(A).

7. Silent touch fastener material, to releasably engage a mating surface and adapted to produce less sound than prior art touch fasteners during rapid separation of the touch fastener material from the mating surface, said touch fastener material comprising:

(a) a planar backing material having an engaging surface thereon, extending therefrom at discrete points and adapted to releasably engage the mating surface; and, (b) the planar backing material having an increased mass to provide an aerial density of the backing thereby providing means for reducing the coupling of noise-producing vibration from said backing material into the surrounding air sufficiently to reduce the sound pressure level by at least 4.2 dB upon separation of said touch fastener material.

8. The silent touch fastener material of claim 7 wherein:

said increased mass of said backing material is produced by bonding a planar high mass supplemental backing material to said backing material.

9. The silent touch fastener material of claim 7 said increased mass material comprising a material having the qualities and characteristics of leaded vinyl.

10. The silent touch fastener material of claim 7 said increased mass material being leaded vinyl.

11. The improvement to touch fastener material of claim 7 wherein:

said backing material has a flexible, high mass material incorporated into said backing material.

12. A touch fastener material according to claim 7 having a noise of separation of less than about 66 dB(A), at a normal rate of separation, when measured at 1 foot from the area of separation of the fastener with one component of the fastener being rigidly attached to a massive structural member chosen to contribute minimum noise to the noise of separation, measurement being made by a sound meter meeting ANSI 51.4-1983 type 1 and set to RMS, fast response and random incidence, the fastener being a hook and loop fastener.

13. A touch fastener according to claim 12 wherein the noise of separation is less than about 60 dB(A).

14. A touch fastener according to claim 13 wherein the noise of separation is less than about 54 dB(A).

* * * * *